US005890412A

United States Patent [19]

Martensen et al.

[11] Patent Number: 5,890,412

[45] Date of Patent: Apr. 6, 1999

[54] CONTROL PLATE OF A HYDRAULIC MACHINE

[75] Inventors: Lars Martensen, Sønderborg; Ove Thorbøl Hansen, Nordborg, both of Denmark

[73] Assignee: Danfoss A/S, Nordborg, Denmark

[21] Appl. No.: 765,554

[22] PCT Filed: Jun. 28, 1995

[86] PCT No.: PCT/DK95/00273

§ 371 Date: Dec. 23, 1996

§ 102(e) Date: Dec. 23, 1996

[87] PCT Pub. No.: WO96/02753

PCT Pub. Date: Feb. 1, 1996

[30] Foreign Application Priority Data

Jul. 13, 1994 [DE] Germany ..... 44 24 671.4

[51] Int. Cl.[6] ..... F04B 1/20

[52] U.S. Cl. ..... 92/57; 417/269; 91/499; 91/486; 92/71; 92/170.1; 74/60

[58] Field of Search ..... 417/269; 91/499, 91/486; 92/57, 71, 170.1; 74/60

[56] References Cited

U.S. PATENT DOCUMENTS

| | | | |
|---|---|---|---|
| 3,582,090 | 6/1971 | Lott et al. | 277/63 |
| 5,385,450 | 1/1995 | Kimura et al. | 417/269 |
| 5,469,776 | 11/1995 | Martensen et al. | 92/170.1 |
| 5,540,139 | 7/1996 | Martensen et al. | 92/57 |
| 5,573,380 | 11/1996 | Martensen et al. | 417/269 |
| 5,584,228 | 12/1996 | Jepsen | 92/71 |
| 5,588,347 | 12/1996 | Jepsen | 92/12.2 |
| 5,598,761 | 2/1997 | Kristensen et al. | 92/57 |
| 5,622,097 | 4/1997 | Martensen et al. | 92/57 |
| 5,671,653 | 9/1997 | Martensen et al. | 92/57 |
| 5,737,996 | 4/1988 | Hansen | 92/12.2 |
| 5,758,566 | 6/1998 | Jepsen et al. | 92/187 |
| 5,762,477 | 1/1998 | Jepsen et al. | 417/269 |

*Primary Examiner*—Timothy Thorpe
*Assistant Examiner*—Ehud Gartenberg
*Attorney, Agent, or Firm*—Lee, Mann, Smith, McWilliams, Sweeney & Ohlson

[57] ABSTRACT

A control plate (1) of a hydraulic machine having a core (2) is disclosed, which at least on its upper side (O), lying in operation against a cylinder drum, is covered with a layer of friction-reducing plastics material (3). The plastics material (3) is joined to the core (2) by means of a connecting element (8) which, as a result of interlocking engagement with the plastics material (3) and/or the core (2), takes up tensile forces substantially at right angles to the upper side (O).

10 Claims, 1 Drawing Sheet

CONTROL PLATE OF A HYDRAULIC MACHINE

Figure 3:
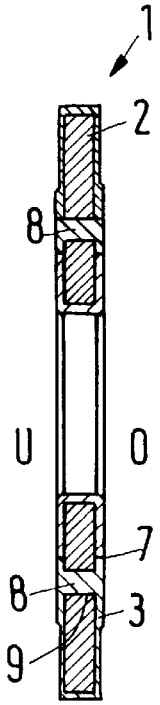

The invention relates to a control plate of a hydraulic machine, having a core, which at least on its upper side lying in operation against a cylinder drum is covered with a layer of a friction-reducing plastics material and which has at least two control openings.

The control openings are generally in the form of control "kidneys", which are optionally divided into different sections separate from one another.

In piston pumps, as known, for example from DE-AS 12 67 985, the cylinder body has to be pressed with a relatively strong pressure against the control plate in order to keep the transition from the cylinders to the control plate as well-sealed as possible. The larger are the unsealed areas in this region, the greater is the leakage, which has an adverse effect on the volumetric efficiency of the machine. Because of the high pressure, considerable frictional forces act on the contact surface and, without supplementary measures, lead relatively quickly to wear and tear or even to destruction of the machine. This phenomenon can be partially counteracted by lubricating the contact surface to reduce friction. The hydraulic fluid is used for that purpose. This presupposes, however, that the hydraulic fluid has satisfactory lubricating properties. This requirement considerably restricts the group of hydraulic fluids that can be used. Fluids which have satisfactory lubricating properties are in many cases harmful from the point of view of their impact on the environment, especially in so far as synthetic oils are concerned.

For that reason, in a machine of the kind mentioned in the introduction, which is intended for use for water, it is known (JP 2-125 979 A) to arrange between the control plate and the cylinder body a plastics material layer which is adhesively secured to the roughened contact surface. A number of manufacturing steps are required for this, however. It is also not always possible to ensure that the plastics material layer is reliably fixed to the cylinder body or to the control plate. In particular, there is a danger that hydraulic fluid under pressure will get between the plastics material layer and the control plate or cylinder body and detach the layer at least partially. This leads very rapidly to serious damage to the machine.

From DE 16 53 529 B2 it is furthermore known to provide a control plate disc with inserts of carbon, which are in the form of linear strips, to reduce the friction between the cylinder body and the control plate disc. Here, however, it is difficult to keep the control plate and the end face of the cylinder body close enough to one another, so that considerable leakage can occur here.

Furthermore, the non-prior-published German patent application 43 01 133 discloses a hydraulic piston machine having a control plate which is provided with a plastics material layer. The plastics material layer is produced by an injection-moulding process. In one embodiment it sheathes the core of the control plate completely, that is, it is also taken right through the control kidneys. A lateral movement of the plastics material layer in relation to the core can largely be prevented by that measure.

It has now been discovered, however, that with control plates of this kind a certain problem arises when air becomes trapped between the core and plastics material as the plastics material layer is being applied to the core, or when the plastics material does not lie completely tightly against the core for other reasons. The core provided with the plastics material is in fact normally machined after application of the plastics material, in which case it is often only the plastics material layer, or more accurately, the surface thereof, that requires machining. The surface machining can be effected, for example, by milling. At the locations where the plastics material is separated from the core by air or other inclusions, the core not only no longer lies against the plastics material, it also no longer adheres to the plastics material there. In injection-moulding there is normally a kind of adhesive or clinging bond between the core and the plastics material layer. If air is trapped, during mechanical machining this can lead to the plastics material being lifted up somewhat because a increased pressure can form in the volume of air. Indeed, the finished external shape obtained after machining is then consistent with the desired shape. Monitoring after production does not show up any faults either. The recovery forces in the plastics material are in some circumstances not sufficiently great to spoil the shaping. In operation, however, when there is a relatively large pressure at the control plate, which may rise to the magnitude of the operational pressure of the hydraulic machine, the plastics material is then again pressed by external forces against the core again, so that the original shaping is again spoilt.

The external shape of the control plate is then no longer consistent with the form that existed after the machining. Leaks form, and these may exceed an acceptable level.

The invention is based on the problem of providing a control plate which can be manufactured with greater reliability.

In the case of a control plate of the kind mentioned in the introduction, this problem is solved in that the plastics material is joined to the core by means of at least one connecting element which, as a result of interlocking engagement with the plastics material and/or the core, takes up tensile forces substantially at right angles to the upper side.

As the plastics material is being applied to the core, for example, by an injection-moulding method, this construction provides a mechanical connection between the core and the plastics material layer which is no longer restricted to pure "adhesion". On the contrary, an interlocking engagement is provided, which is able to take up relatively large tensile forces, such as those that may occur during the subsequent machining. Even in the unfortunate event of part of the plastics material not clinging to the core with the necessary strength, this construction ensures that the plastics material is unable to lift away from the core during machining. After machining, the desired geometry or shape of the control plate is therefore obtained, which does not change even during subsequent use in the hydraulic machine.

In a preferred embodiment, provision is made for the connecting element to be constructed in one piece with the plastics material. The connecting element can then be connected in a simple manner to the core at the same time as the plastics material layer is being applied. This applies particularly when the plastics material is being moulded onto the core, for example, by an injection-moulding process.

The connecting element preferably has a widened portion which lies against a face formed on the core, which face has at least one component running substantially parallel to the upper side. The widened portion thus engages beneath the core. In this simple manner an interlocking engagement is ensured.

It is here especially preferred for the connecting element to pass through the core in a through-opening and for the face to be arranged on the underside of the core. The connecting element is thus constructed like a rivet which passes through the core. The "snap head" of the rivet is thus located on the underside of the core. Such a connection is able to take up relatively great tensile forces.

It is also preferred for the enlarged portion to be formed by a layer of the plastics material which covers the underside, at least in some areas. In many cases the core of the control plate will be completely sheathed in plastics material. The connecting element then provides an additional mechanical connection between the upper side and the underside, that is, holds the plastics material in engagement with the core with great reliability not only at the upper side but also at the underside. It is precisely in this case that fixing of the plastics material to the core can be improved without difficulty merely by providing the core with through-openings, in the simplest case with bores, before the plastics material is applied to the core.

The inside width of the through-opening is preferably larger than the thickness of the layer. The inside width is the same as the diameter in the case of a cylindrical bore. An injection-moulded plastics material contracts somewhat as it hardens. This contraction is dependent on the volume of the plastics material there is to harden. If a relatively large volume is hardening, it contracts more strongly than a small volume, the contraction generally amounting to just a few percent. Because the connecting element is fixed to the plastics material layer, however, this contraction causes the plastics material layer to be drawn more closely against the core and thus effects an improved engagement with a higher retention force.

In another preferred construction, the core has a recess provided with an undercut in which the connecting element engages. This construction is especially advantageous when, for one reason or another, the core cannot be provided with a through-bore. A recess with an undercut is also able to fulfil the fixing function with the required reliability. Here too, the desired interlocking engagement is achieved.

It is here especially preferred for the connecting element to be of dovetailed shape. The complementary dovetail recess in the core can be made relatively easily, for example, by milling.

The connecting element is preferably arranged in a region lying circumferentially between the control kidneys. The danger of leakage is greatest there. In the region of the control kidneys themselves a certain amount of leakage is tolerated, for example, in order to cool the control plate in that area. On the other hand, the region between the control kidneys is so configured by the connecting element that it can be manufactured with satisfactory precision. Leakage here is largely avoided.

The layer in a region lying within the circular ring, in which the control kidneys also lie, is preferably of increased thickness and the connecting element is arranged in the region of increased thickness. Only the region of increased thickness need be manufactured with the necessary accuracy. It is therefore sufficient to ensure that this region lies correctly against the core of the control plate and is unable to lift away during machining.

Figure 1:
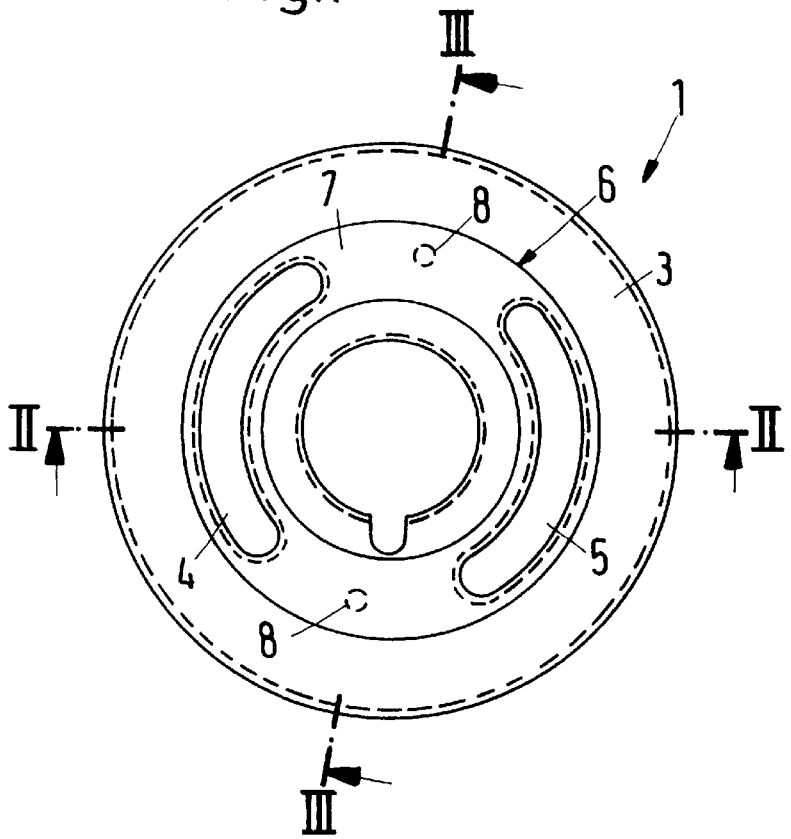
Figure 2:
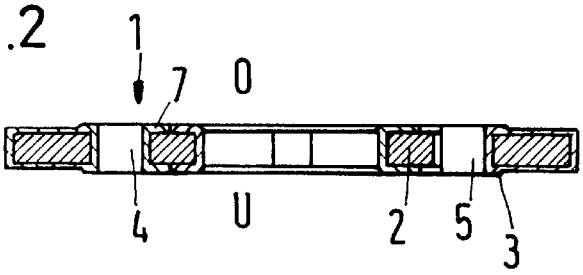
Figure 4:
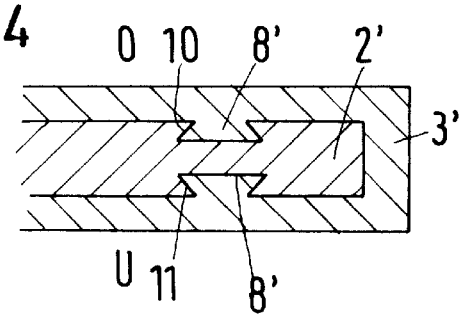

The invention is described hereinafter with reference to preferred embodiments in conjunction with the drawings, in which FIG. 1 is a plan view of a control plate, FIG. 2 is a section II—II according to FIG. 1, FIG. 3 is a section III—III according to FIG. 1 and FIG. 4 shows in section part of a further construction of a control plate.

A control plate 1 has a core 2 which is illustrated in FIG. 1 in broken lines. The core is made of metal, for example, steel. It is completely sheathed with a friction-reducing plastics material 3. The control plate 1 has two control kidneys 4, 5. The plastics material 3 is taken right through these control kidneys 4, 5, that is, it lines their inner walls so that here there are no gaps between the plastics material 3 and the core 2.

Within a circular ring 6, in which the control kidneys 4, 5 also lie, the plastics material 3 has a region 7 of increased thickness. In operation, a cylinder drum of a hydraulic axial piston machine which rotates relative to the control plate 1 lies in this region 7.

The plastics material 3 is moulded around the core 2 of the control plate 1, for example, by means of an injection-moulding method. This moulding method is normally sufficient to cause the plastics material 3 to cling to the core 2 with the necessary strength and reliability. Now and again, however, air becomes trapped during moulding between the plastics material 3 and the core 2. This trapped air prevents the plastics material 3 from adhering to the core 2, so that when its surface is subsequently machined it can be lifted away from the core. The machining, for example, a milling operation, then removes too much material. In normal output monitoring this is often not even detected, because the plastics material is plastically deformed during the machining, that is, does not spring back to its initial position again. This recovery is not effected until the control plate is used at relatively high pressures, such as those occurring, for example, in a hydraulic machine.

To prevent the plastics material 3 lifting away from the core 2 during machining, in the region 7 of increased thickness there are provided connecting elements 8 which, in the embodiment shown in FIG. 3, pass, as a rivet would, through the core 2, namely in bores 9. The connecting elements 8 then connect the plastics material 3 on the upper side O with the plastics material 3 on the underside U. They are capable of taking up even relatively large tensile forces, so that the plastics material 3 is prevented from lifting away during a machining process.

Even if no plastics material 3 is provided on the underside U, one can ensure that the connecting elements 8 are enlarged there so that they form a kind of rivet. The enlargement at the end of the connecting elements 8 then engages beneath the core 2 so that the connecting element 8 engages in an interlocking manner with the core 2. The connecting elements 8 are joined in one piece to the plastics material at the upper side O. They can be made especially easily by providing the core with the necessary bores 9 before the plastics material is moulded on. The connecting elements 8 are then produced automatically during moulding.

The diameter of the bore 9, or if a through-opening of a form other than a cylindrical form is used, its inside width, is larger than the thickness of the plastics material 3, and in fact larger than the thickness in the thicker region 7. When the plastics material shrinks as it hardens, the connecting elements 8 shrink somewhat more strongly than the layer of the plastics material 3 on the upper side. The plastics material 3 on the upper side O is consequently drawn towards the core 2 with greater force.

FIG. 4 shows an alternative construction in which elements which correspond to those of FIG. 1 to 3 are indicated by primed numbers. Here, the core 2' has no through-bore, but on its upper side O and on its underside U has dovetail recesses 10, 11, that is, recesses with undercuts that are formed by sloping side walls. Connecting elements 8' of the plastics material 3' engage in these recesses. These connecting elements are likewise of dovetailed shape, that is, they widen outwards in the direction towards the inside of the core. This also results in an interlocking engagement. Each recess 10, 11 and connecting element 8' has a surface component which runs substantially parallel to the upper side O or the underside U. Here too, the plastics material 3' can be prevented from lifting away from the core 2' with great reliability, even when tensile forces act here.

As is clear from FIG. 1, the connecting elements 8 are arranged in the region between the control kidneys 4, 5. This is the region which is most at risk. It is here too that manufacture must be effected with the greatest precision. The dovetail connections illustrated in FIG. 4 can also be used in place of the rivet-shaped connecting elements 8 illustrated in FIG. 1. The connecting elements can, of course, if necessary also be used in the region between the control kidneys 4, 5 and the radial outer edge of the control plate 1.

The "friction-reducing" property of the plastics material 3 is always with respect, of course, to the material with which the control plate is subsequently to co-operate. As a rule, this is a metal, from which the cylinder drum is manufactured. By suitable pairing of materials, coefficients of friction can be achieved here which are quite comparable with or even surpass the values of an oil-lubricated contact surface. Suitable plastics material for the injection-moulded part are in particular materials from the group of high-strength thermoplastic plastics materials based on polyarylether ketones, in particular polyether ether ketones, polyamides, polyacetals, polyaryl ethers, polyethylene terephthalates, polyphenylene sulphides, polysulphones, polyether sulphones, polyether imides, polyamideimide, polyacrylates, phenol resins, such as novolak resins, or similar substances: glass, graphite, polytetrafluoroethylene or carbon, especially in fibre form, can be used as fillers. When using such materials, it is possible to use even water as hydraulic fluid.

We claim:

1. A control plate for a hydraulic machine, the control plate having a core, the core at least on an upper side which in operation bears against a cylinder drum being covered with a layer of a friction-reducing plastics material of a generally predetermined thickness and having at least two control openings, the core also having an underside, the plastics material being joined to the core by means of at least one connecting element having an interlocking engagement with at least one of the plastics material and the core, the connecting element bearing tensile forces substantially at right angles to the upper side.

2. A control plate according to claim 1, in which the connecting element is constructed in one piece with the plastics material.

3. A control plate according to claim 1, in which the connecting element has a widened portion extending against a face formed in the core, said face having at least one component running substantially parallel to the upper side.

4. A control plate according to claim 3, in which the connecting element passes through the core in a through-opening and the face is arranged on the underside of the core.

5. A control plate according to claim 4, in which the enlarged portion is formed by a layer of the plastics material which covers at least some areas of the underside.

6. A control plate according to claim 4, in which the through-opening has an inside width larger than the thickness of the layer of plastics material.

7. A control plate according to claim 1, in which the core has a recess provided with an undercut in which the connecting element is engaged.

8. A control plate according to claim 7, in which the connecting element is of dovetailed shape.

9. A control plate according to claim 1, in which the connecting element is located in a region lying circumferentially between the control openings.

10. A control plate according to claim 1, in which the layer of plastics material in a region located within a circular ring, in which the control openings also lie, is of increased thickness and the connecting element is located in the region of increased thickness.

* * * * *